US006032887A

United States Patent [19]

Strasser et al.

[11] Patent Number: 6,032,887

[45] Date of Patent: Mar. 7, 2000

[54] CIRCUIT GRINDING APPARATUS WITH HIGH-PRESSURE ROLL PRESS AND SIFTER

[75] Inventors: Siegfried Strasser, Much; Franz Göddecke, Leverkusen, both of Germany

[73] Assignee: KHD Humboldt Wedag AG, Cologne, Germany

[21] Appl. No.: 09/103,280

[22] Filed: Jun. 23, 1998

[30] Foreign Application Priority Data

Jun. 23, 1997 [DE] Germany ..... 197 26 523

[51] Int. Cl.[7] ..... B02C 23/12

[52] U.S. Cl. ..... 241/79; 241/79.1; 241/80

[58] Field of Search ..... 241/80, 97, 79.1, 241/79, 235

[56] References Cited

U.S. PATENT DOCUMENTS

| | | | |
|---|---|---|---|
| 2,138,715 | 11/1938 | Thorsen . | |
| 2,552,360 | 5/1951 | Zichis . | |
| 2,612,321 | 9/1952 | Sidwell et al. | 241/80 |
| 4,134,556 | 1/1979 | Ehrlich et al. . | |
| 4,703,897 | 11/1987 | Beisner et al. | 241/80 |

FOREIGN PATENT DOCUMENTS

| | | |
|---|---|---|
| 939 301 | 2/1956 | Germany . |
| 35 18 543 | 3/1993 | Germany . |

OTHER PUBLICATIONS

KHD Humboldt Wedag Literature entitled "Rollenpressen" 2–300d No Date avail.

*Primary Examiner*—Mark Rosenbaum
*Attorney, Agent, or Firm*—Hill & Simpson

[57] ABSTRACT

A compact circuit grinding apparatus wherein two press rolls are housed in one housing, comprising of two stationary lateral end walls, between which is arranged a material conveyor ring, which is rotatably seated and can be set into rotation, for an internal material circulation. The inflow of material takes place through one or more openings in one or both housing end walls and the outflow of material likewise takes place laterally through one or more openings in the housing end wall. A sifter is arranged underneath the nip of the two rolls in the housing. The sifter can comprise a static or dynamic sifter and a flow of air through the sifter removes the fines from the crushed granular material.

6 Claims, 1 Drawing Sheet

CIRCUIT GRINDING APPARATUS WITH HIGH-PRESSURE ROLL PRESS AND SIFTER

BACKGROUND OF THE INVENTION

The invention relates to a circuit grinding apparatus with a high-pressure roll press for the pressure disintegration of granular material, and with an integrated sifter or separator, whereby both units are surrounded by a housing consisting of two stationary lateral end walls, between which is arranged a material conveyor ring for an internal circulation of material, said conveyor ring being rotatably seated and capable of being set into rotation, whereby the inflow of material takes place through one or more openings in one or both housing end walls from the side, and the outflow of material likewise takes place laterally through one or more openings in the housing end wall.

Such an arrangement is disclosed in German patent application DE-A-196 30 687.6 (U.S. Ser. No. 08/844,583), which disclosure is incorporated herein by reference, in which a very compact circuit grinding apparatus with a two-roll press for pressure disintegration of granular material and with an integrated sifter was proposed. The two rolls of the roll press, in particular a high-pressure interparticle crushing roller mill, are thereby surrounded by a housing consisting of two stationary, i.e. non-rotating, lateral end walls, between which is arranged a material conveyor ring that is rotatably seated and can be set into rotation by a rotary drive, for an internal circuit of material. This rotatably seated material conveyor ring of the housing rotates at about e.g. 40 to 80% of the critical RPM, i.e., the ring takes along the press discharge material (scab material), according to the organization of lifter elements in the conveyor ring, up to the region approximately of the upper vertex point of the ring, and lets this material fall from above into the nip, by which means the internal material circuit arises. Bucket conveyors or other space-consuming conveyance means for transporting the press discharge material to the press inlet are omitted. With the rotating material conveyor ring, a multiple internal material circuit with multiple material bed stressing of the material is thus achieved in the smallest space and with a low outlay of machine equipment, whereby relatively high material circuit loads, due e.g. to reduced roller press pressure, taking into account the thereby increased stability of the rolls, are thereby to be managed.

In order to achieve greater finenesses in the grinding stock, in the housing of the compact circuit grinding apparatus of German published application DE-A-196 30 687.6 there is arranged the rotatably seated rod-type basket of a dynamic rod-type basket sifter, lying horizontally above the roller press, whereby the rod-type basket, through which sifting air flows, acquires the press discharge material discarded from the region of the upper vertex point of the material conveyor ring, and separates out the coarse grain portion therefrom, which portion is then supplied to the rolls lying thereunder for purposes of further pulverization, while the sifter air, loaded with the fine material portion, is drawn off from the rod-type basket and separated from the sifter air outside the circuit grinding apparatus.

SUMMARY OF THE INVENTION

The invention is based on the aim of further developing the circuit grinding apparatus described above, in particular with respect to the specific energy requirement, which is low overall, and the problem-free grinding even of moist material.

It is characteristic for the inventive circuit grinding means with roll press and integrated sifter, that the sifter is arranged underneath the nip of the two rolls in the housing with the rotatably seated material conveyor ring. It is thereby achieved first of all that the sifter separates the fine material from the press discharge material before the latter reaches the rotating material conveyor ring and is transported upward by it, and removes the fine material from the housing of the circuit grinding means, so that the rotating material conveyor ring avoids the requirement of transporting the separated fine material portion. This has a particularly advantageous effect on the low specific energy requirement. In particular, if the sifter arranged underneath the roll press is a driveless static sifter, namely, according to a further feature of the invention, a static cascade sifter with at least one row of guide plates arranged one over the other, inclined at an angle downward, in a cascading manner or in louvered fashion, through whose intermediate spaces sifter air flows in a cross-current. A static cascade sifter of this type acts simultaneously as a de-agglomerator for the agglomerates (scabs) pressed by the roll press. The de-agglomerization of the scabs is accomplished by the cascade sifter at practically no expense.

Then the scabs of the press discharge material are handed upward to the cascade sifter, if warranted, together with the fresh material supplied to the circuit grinding apparatus, such as, e.g., cement clinker chunks, and the material mixture moves via gravity from above to below via the guide plates, arranged in cascading fashion or in louvered fashion, and the mixture is thereby ground again, whereby the scab material is de-agglomerated, and sifter air thereby simultaneously flows through it, approximately in a cross-current, said air thereby being able to sift out the fine material, contained both in the scab material and also, if warranted, in the fresh material, from the material that moves from above to below through the sifter, and only the rough sifter material portion, free of the fine material, reaches the rotating material conveyor ring and is taken along upwards by it, and from the upper vertex point again flows into the nip of the roll press. The de-agglomeration of the scab material can effectively be supported by the fresh material chunks, such as cement clinker chunks, which, like the ground bodies, fall downward in cascading fashion. A separate, separately driven deagglomerator, such as, e.g., an impact hammer mill for the de-agglomeration of the press scabs before their entry into the sifter, is thereby superfluous.

If the fresh material is moist, as is generally the case given cement raw material for grinding cement raw meal, so that it cannot be pressed without difficulty in the nip of the high-pressure roll press, and if the pressed scab material is correspondingly moist, so that it could adhere to the rotating material conveyor ring, it is possible to operate the sifter arranged under the roll press, e.g., the cascade sifter, with hot gas instead of with air, by which means the moist material can effectively be pre-dried in the sifter during its de-agglomeration. If only a dry rough material portion is supplied to the high-pressure roll press, quiet operation of the roll press is thus ensured.

If the fresh material consists of hot material, e.g., hot, insufficiently cooled cement clinkers, then in the inventive solution this hot material can also be cooled at the same time in the cascade sifter, which is advantageous for the operation of the high-pressure roll press connected downstream. This is because it would be harmful to supply very hot material to the interparticle crushing roll press, which could lead to excessive heat stress, such as surface distortion, etc., of the press rolls.

The inventive compact circuit grinding apparatus with integrated high-pressure roll press and sifter also makes it possible, in contrast to previous interparticle crushing high-pressure roll presses, to operate the grinding apparatus with a pressure that is not too high, in order thereby to produce less hard material scabs with less sharp-edged particles, by which means the wear in the roll press itself, as well as in the sifter, is reduced. At the same time, by means of a pressing that is not too high of the ground material, a broader grain distribution curve in the ground product is achieved, which is desirable in many products, such as, e.g., cement. The less hard the scabs coming from the high-pressure roll press are, the more easily they can then be de-agglomerated in the immediately subsequent sifter, such as, e.g., a cascade sifter or a rod-type basket sifter. The increased circuit grinding apparatus circulation rate that is to be expected given a lower pressure of the scabs can then be handled unproblematically by the sifter, in particular if the sifter is a static cascade sifter.

The sifter arranged inside the rotating material conveyor ring, underneath the roll press, can however also be a dynamic sifter whose rotating rod-type basket is arranged underneath the press rolls, parallel thereto, whereby in the region of at least one end of the rod-type basket, in the adjacent housing end wall, a refuse discharge bend is arranged for drawing off the sifter air loaded with fine material.

BRIEF DESCRIPTION OF THE DRAWINGS

The invention and its further features and advantages are explained in more detail on the basis of the exemplary embodiments shown schematically in the figures.

DETAILED DESCRIPTION OF THE PREFERRED EMBODIMENTS

Figure 1:
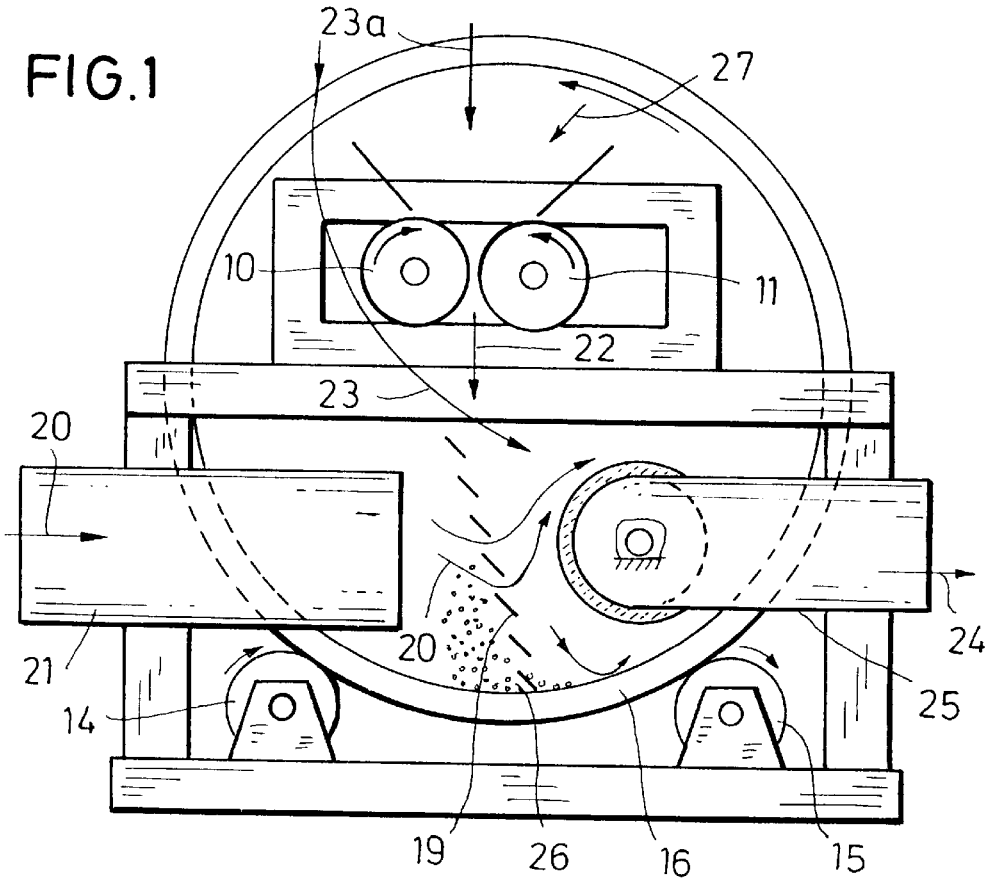
FIG. 1 shows a vertical section through the inventive compact circuit grinding apparatus, transverse to the axis of rotation of the rotatably seated material conveyor ring, with integrated high-pressure roll press and sifter.

In the inventive circuit grinding apparatus with high-pressure roll press for interparticle crushing of granular material, and having at least one sifter, two rolls 10, 11, forming the high-pressure roll press, which are separated from one another by a nip and are driven in opposed directions, are surrounded or housed by a housing, consisting of two stationary, i.e. non-rotating, lateral end walls 12, 13, between which a material conveyor ring 16, rotatably seated on rolls 14 and 15, is arranged for an internal material circuit. The rotation of the material conveyor ring 16 takes place via its cylindrical coating, e.g., by means of the driven bearing roll 15. In the exemplary embodiment, the pillow or bearing blocks of the two rolls 10, 11 are seated in a machine frame 17, 18, which can be a part of the stationary lateral end walls 12, 13.

Underneath the nip of the roll press 10, 11 there is arranged a static cascade sifter, with which at least one series of guide plates 19 inclined obliquely downwards in cascade or louvered fashion, through whose intermediate spaces sifter air 20 flows in a cross-current, which air is introduced from the side through at least one supply housing 21, through at least one of the lateral end walls 12, 13, into the space underneath the roll press. This cascade sifter, through which sifter air flows, acts as a de-agglomerator for the roll press scabs 22 that are supplied to the cascade sifter together with fresh ground material 23. The fresh material 23, introduced into at least one of the housing end walls 12, 13 through a side opening, can however also be supplied via a line 23*a* directly from above the nip of the roll press 10, 11, through a side opening positioned higher. In any case, the sifter air 20 sifts the fine material portion out from the sifting material, and the sifter air, charged with fine material 24, is drawn off from the circuit grinding apparatus via a line 25, while the rough granular portion 26, separated from the sifting material by the sifter, flows to the inner track or inner wall, provided with lifter elements, of the rotating material conveyor ring 16, which takes the rough granular portion 26 along upwards up to a point preceding the upper vertex point of the ring 16, and releases this material 27 into the nip of the roll press 10, 11. That is, the interparticle crushing in the high-pressure roll press 10, 11 is relieved of fine material 24.

Given a moist fresh feed material 23 or, respectively, 23*a*, and thus given correspondingly moist material scabs 22, whereby the moist material can adhere to the inner walls of the material conveyor ring 16, a hot gas stream is used as sifter air 20, which stream can effectively dry the moist material during its de-agglomeration in the cascade sifter, so that the energy-saving circuit grinding apparatus, which is characterized by an extraordinarily low specific energy requirement (kWh/t), can also be used to grind moist material.

Figure 2:
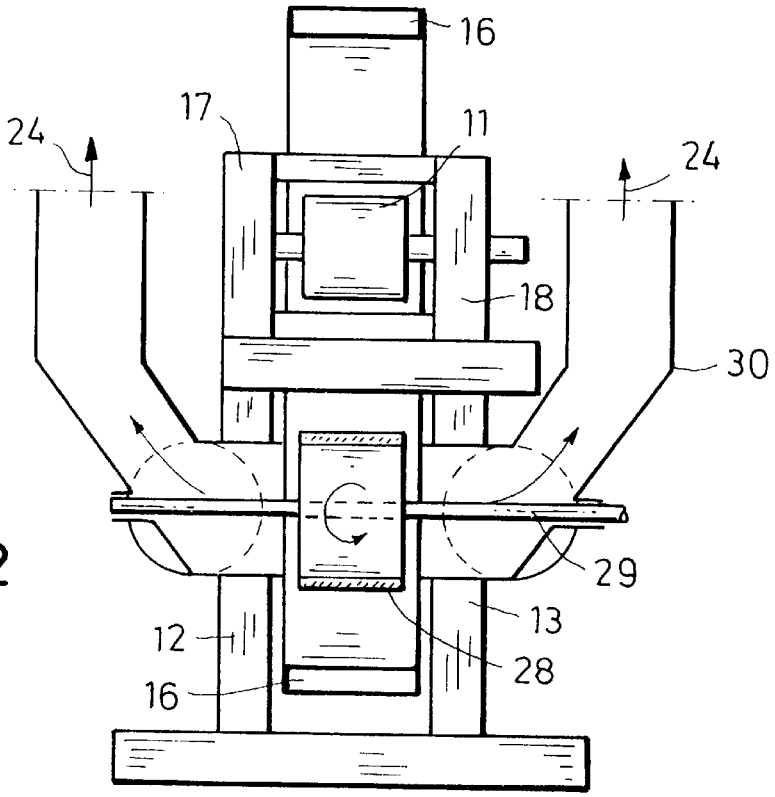
FIG. 2 shows the grinding apparatus of FIG. 1, in vertical section along a plane through the nip of the high-pressure roll press.

FIG. 2 shows that underneath the roll press 10, 11 inside the rotating material conveyor ring 16, instead of the static cascade sifter 19, or even in addition to it, a dynamic sifter with a rotatably seated rod-type basket 28 can be arranged, driven, e.g., via an RPM-controllable electromotor, via a shaft 29. The housing walls 12, 13 of the grinding apparatus thereby simultaneously form the sifter housing. In the area of the ends of the rod-type basket 28, refuse or exhaust bends 30, 30*a*, for the drawing off of the sifter air charged with fine material 24, are arranged in the adjacent housing end walls 12, 13.

It is also possible to connect an external sifter 34, in particular a dynamic rod-type basket sifter, downstream from the compact circuit grinding apparatus of FIGS. 1 or 2, which sifter separates out from the fine material 24 the finest material 34 contained therein, while the grits 36 obtained are recirculated into the circuit grinding apparatus with the rotating material conveyor ring 16.

In the inventive circuit grinding apparatus, apart from roll presses, roll breakers or roll mills can also be used, which as a rule operate with a lower roll pressure force than do roll presses.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A circuit grinding apparatus for the interparticle crushing of granular material with an integrated sifter, comprising, a housing having two stationary lateral end walls and a conveyor ring rotatably seated in and extending therebetween, a pair of rollers axially spaced from one another and extending between said lateral ends walls, said rollers defining a nip between one another and being adapted for rotation in opposite directions, at least one product material admission for admitting said granular product material into said housing, at least one product material discharge for discharging comminuted granular product material from said housing, said conveyor ring being adapted to re-circulate said granular product within said housing and delivery said granular product material to said nip one or more times for pressure communition, said sifter being arranged underneath said nip of said two rolls in said housing, wherein said sifter is a static cascade sifter that operates simultaneously as a de-agglomerator, with at least one row of guide plates inclined downward and arranged one over the other in cascade or louvered fashion, through whose intermediate spaces there flows sifter air in a cross-current from an air inlet to an air outlet.

2. The circuit grinding apparatus according to claim 1, wherein inside said rotating material conveyor ring said static cascade sifter is followed by a dynamic sifter whose rotating rod-type basket is arranged underneath said rollers parallel thereto, and in that in the region of at least one end of the rod-type basket, an exhaust outlet is arranged in the adjacent housing end wall for drawing off the sifter air charged with fine material.

3. The circuit grinding apparatus according to claim 1, wherein an external dynamic rod-type basket sifter is arranged downstream from said air inlet to receive said separated fine material.

4. A circuit grinding apparatus for the interparticle crushing of granular material, a housing consisting of two stationary lateral end walls, a material conveyor ring arranged between said two end walls for an internal circulation of material, said conveyor ring being rotatably seated and capable of being set into rotation, a pair of high pressure rolls spaced from one another to define a nip therebetween and extending between said end walls within said housing, at least one opening in at least one of said housing end walls for an inflow of granular material, at least one opening in at least one of said housing end walls for an outflow of crushed material, and a sifter arranged underneath said nip of said two rolls in the housing, said sifter arranged underneath the rolls being a static cascade sifter that operates simultaneously as a de-agglomerator, with at least one row of guide plates inclined downward and arranged one over the other in cascade or louvered fashion, through whose intermediate spaces there flows sifter air in a cross-current from an air inlet to an air outlet.

5. The circuit grinding apparatus according to claim 4, wherein inside said material conveyor ring said static cascade sifter is followed by a dynamic sifter having a rotating rod-type basket arranged underneath the rolls parallel thereto, and wherein in the region of at least one end of said rod-type basket, an exhaust outlet is arranged in the adjacent housing end wall for drawing off the sifter air charged with fine material.

6. The circuit grinding apparatus according to claim 4, wherein an external dynamic rod-type basket sifter is arranged downstream from said air outlet to receive said separated fine material.

* * * * *